United States Patent [19]

McArdle

[11] 4,266,095

[45] May 5, 1981

[54] BINARY CODE RANDOMIZING SYSTEM

[76] Inventor: Beryl L. McArdle, 1935 Brighton-Henrietta Town Line Rd., Rochester, N.Y. 14618

[21] Appl. No.: 136,739

[22] Filed: Jan. 4, 1950

[51] Int. Cl.[3] ..... H04K 1/00

[52] U.S. Cl. ..... 179/1.5 R

[58] Field of Search ..... 179/15.6, 1.5 R; 250/27 CC, 27 GT, 27 PSC, 27 TR; 178/22

[56] References Cited

U.S. PATENT DOCUMENTS

| | | | |
|---|---|---|---|
| 2,438,908 | 4/1948 | Goodall . | |
| 2,486,391 | 11/1949 | Cunningham . | |
| 2,516,146 | 7/1950 | Prugh . | |
| 2,531,846 | 11/1950 | Goodall . | |
| 3,944,745 | 3/1976 | Gannett | 179/1.5 R |
| 4,178,474 | 12/1979 | Joel, Jr. | 179/1.5 R |

*Primary Examiner*—Howard A. Birmiel

EXEMPLARY CLAIM

1. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n−1) of said binary digits corresponding respectively with a selected binary digit in each of the preceding (n−1) groups of said first pulse train; means for combining said first and second pulse trains to develop a third pulse train; and means for utilizing said third pulse train.

10 Claims, 3 Drawing Figures

BINARY CODE RANDOMIZING SYSTEM

This invention relates to binary code randomizing systems and more particularly to such systems for use in secret communication systems. Although not limited thereto, the arrangements of the present invention are particularly adapted for use in communication systems of the type disclosed and claimed in application Ser. No. 131,436, Beryl L. McArdle, filed Dec. 6, 1949 and assigned to the same assignee as the present application.

In communication systems of the type disclosed in the above-mentioned copending patent application, a voltage wave varying in time to represent intelligence, as for example, is first converted into a series of discrete samples or counts corresponding to the amplitude of the voltage wave. This operation may be referred to as quantizing. These samples, which may have 16 different values, are then converted into a suitable numerical code, as for example a binary code, in such a manner that each sample is represented by a set or group of marks or spaces, each occupying a different interval of time and hereinafter referred to as a binary digit. The train of binary digits is combined with a second train of marks and spaces which has been randomly developed in accordance with the noise component accompanying the intelligence signal. The resultant combined pulse train is the signal which is transmitted by any suitable means to a receiver at a remote point. At the receiving terminal, arrangements are provided for developing from the combined transmitted pulse train an intelligence signal wave substantially corresponding with the originally transmitted intelligence signal wave.

In systems such as those briefly discussed above, during periods of silence the two most frequent counts appearing in the plain text binary code would be seven and eight, corresponding to the first level below and the first level above the no-signal point in the coding tube. As disclosed and claimed in the above-mentioned patent application, the security is enhanced by developing a low-level random noise signal and injecting it into the speech channel. The amplitude of this noise signal is adjusted so that it is sufficient to modulate the coding tube over the middle four levels, that is, the counts of six, seven, eight and nine. It has been found in practice, however, that thus limiting the counts of the silent intervals to these four levels is not entirely adequate, under all circumstances, to avoid providing a clue which might aid the unauthorized intercepter to decipher the intelligence being transmitted.

It is an object of the present invention, therefore, to provide means for enhancing the security achieved in secret communication systems.

It is another object of the present invention to provide means, in a secret communication system, to break up or randomize the pulse patterns of the binary code groups which are obtained in the presence of low-level random noise.

It is a further object of the present invention to provide an improved dynamic pulse storage network which is especially adapted for use in an arrangement for breaking up or randomizing the several binary code groups which would otherwise normally correspond with the presence of low-level random noise.

The present invention contemplates a secret communication system including a source of an intelligence signal wave, means for periodically sampling the signal wave at predetermined intervals, and means for developing from the samples thus obtained a first pulse train comprising groups each having n binary digits. In accordance with the present invention, means are provided for developing a second pulse train comprising groups of n binary digits, (n−1) of the latter binary digits corresponding with a selected binary digit in each of the preceding (n−1) groups of the first pulse train. The latter means preferably comprises a pulse storage network and means, which may include a recirculation gate, for passing the first pulse train through the network a plurality of times, as for example (n−1) times. There are also provided means for combining the first and second pulse trains to develop a third pulse train, as well as means for utilizing the third pulse train.

The present invention also contemplates a pulse storage network of the dynamic type comprising the combination of a plurality of cascaded stages each comprising a trigger circuit and a gating rectifier. An integrating network is preferably inserted between each trigger circuit and its associated gating rectifier. This network preferably has a time constant of approximately three-quarters of a digit interval of the binary digits to be stored. A source of periodic pulses for resetting the trigger circuits is provided, as well as a source of pulses delayed with respect to the periodic pulses. Means are provided for applying the delayed pulses to each the gating rectifiers. The trigger circuits are preferably of the Eccles-Jordan type, and the gating rectifiers are preferably crystal diodes. In accordance with the invention, each rectifier is unblocked in the presence of a mark in the associated trigger circuit and blocked in the presence of a space in the trigger circuit. Thus each of the gating rectifiers passes each delayed pulse only when a mark is present in the associated trigger circuit, the passed delayed pulse serving to trigger the next succeeding trigger circuit.

The above and other objects and features of the present invention will be better understood by referring to the following description taken in connection with the accompanying drawings, in which like components are designated by like reference numerals and in which.

Figure 3:
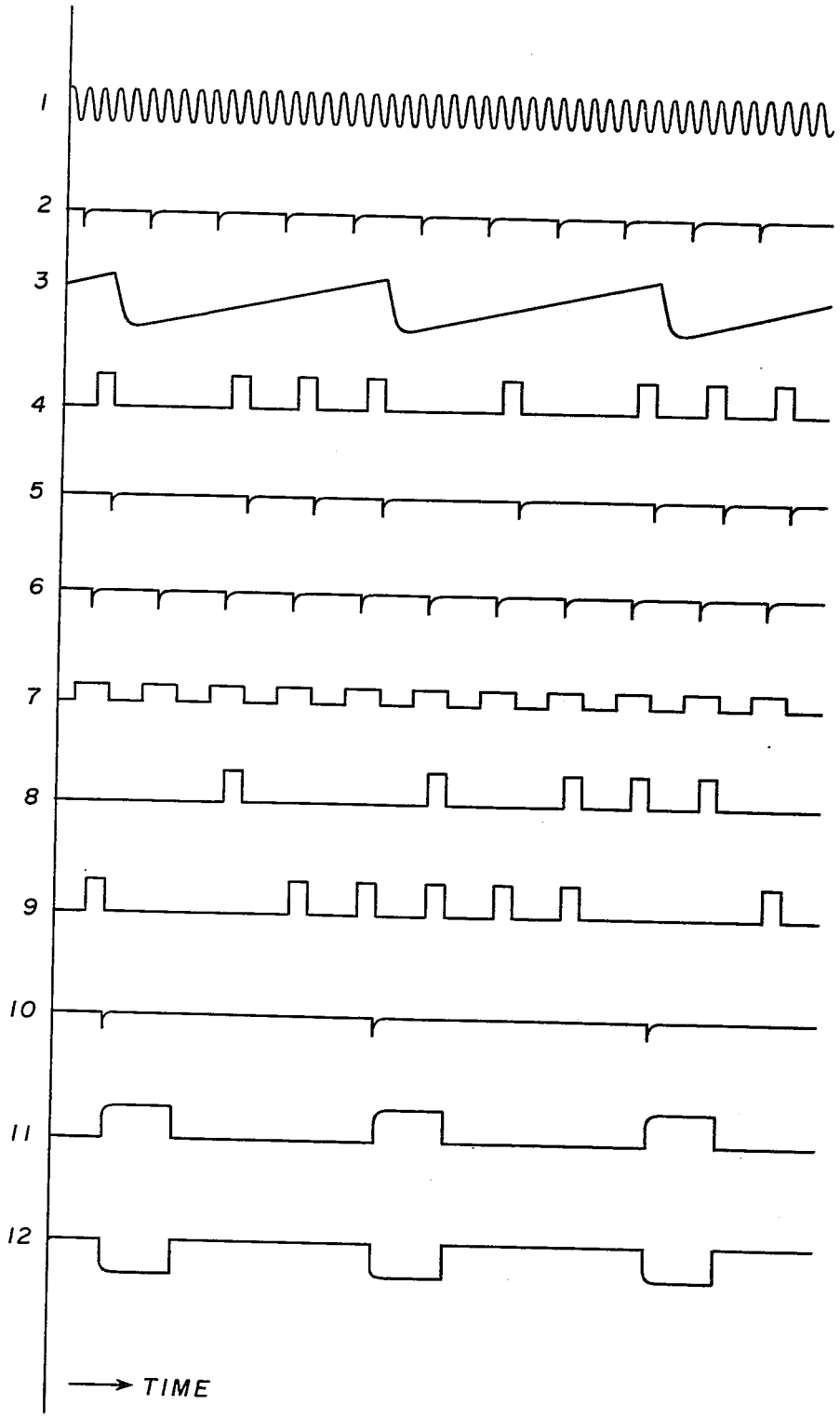
FIG. 3 is a graphical representation, to a common time base, of the waveforms which exist in various portions of the system of FIGS. 1 and 2.

In the drawings, the encircled reference numerals refer to the corresponding approximate curves or wave shapes of FIG. 3. Reference will be made to these curves throughout the following description as an aid to a better understanding of the operation of the present invention. Solely for the purpose of illustration, it will be assumed that the system shown in the drawings and about to be described is intended for the transmission of a voice signal having frequencies up to approximately 3,000 cycles per second, that this intelligence wave will be sampled at a rate of 6.25 kilocycles per second, that it will be quantized to the nearest of 16 discrete amplitude levels, and that the resultant signal will be utilized to generate a code comprising sets of four binary digits, these digits occurring at the rate of 25,000 per second and each having a width of approximately 10 microseconds. It will be understood that any or all of these specific values, here chosen for illustration, may be varied over wide limits without departing from the scope of the present invention.

Figure 1:
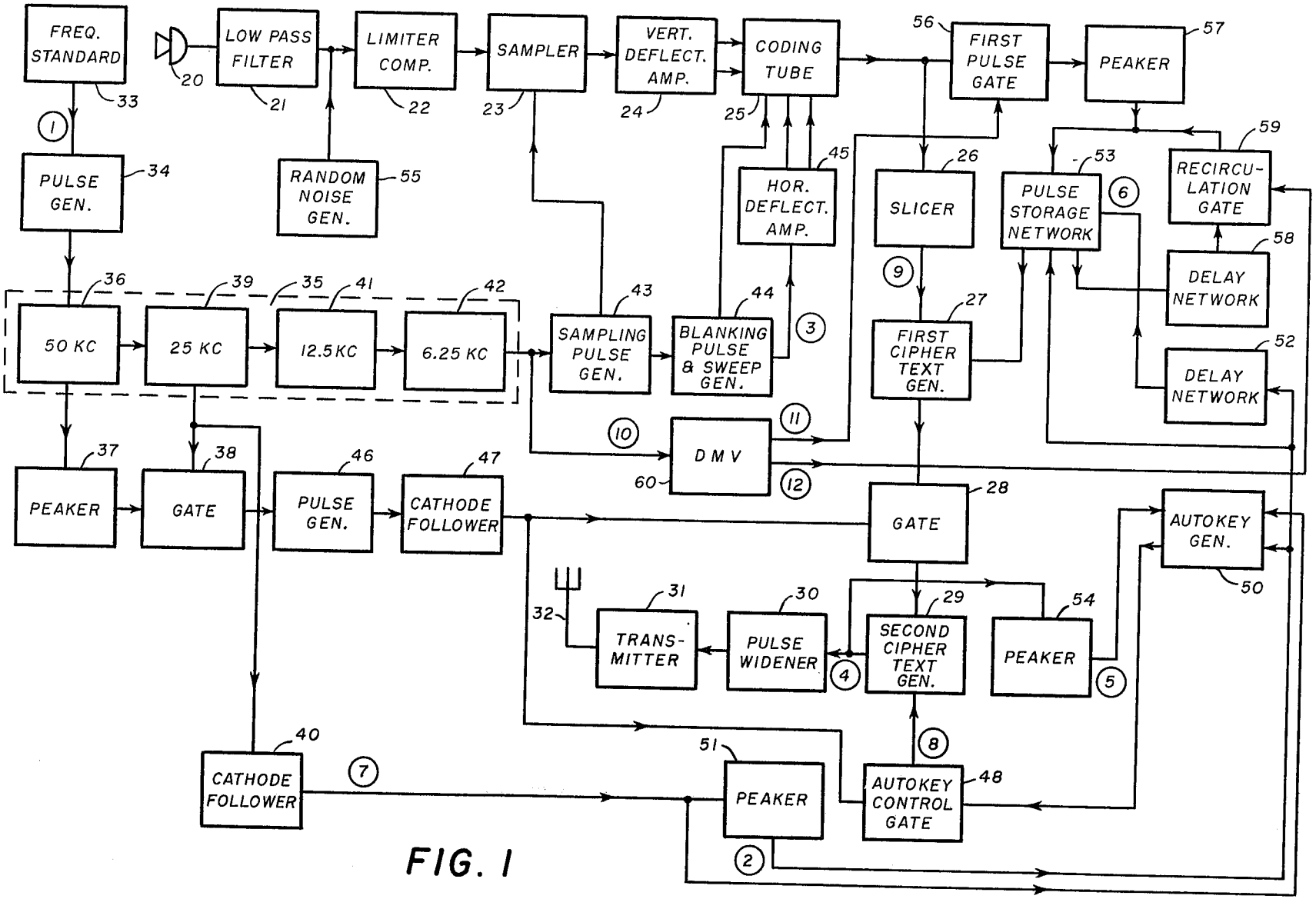
FIG. 1 is a block diagram of the transmitting portion of a secret communication system incorporating the binary code randomizing system of the present invention.

Referring now to the drawings, there is shown in FIG. 1 a block diagram of the transmitting portion of a secret communication system incorporating the binary code randomizing system of the present invention. The intelligence signal path will first be traced from the point where the signal is sound energy to the point where it is radiated from the transmitter. A transducer or microphone 20 is provided for converting the sound energy to be transmitted into an intelligence signal wave. This wave is passed through a low-pass filter 21 having a cutoff frequency, for example, of 3,000 cycles per second. The output of filter 21 passes through a limiter-compressor unit 22, the output of which in turn is sampled in unit 23 at suitable intervals, as for example at the rate of 6.25 kilocycles per second. The output of sampling unit 23 is supplied to a vertical deflection amplifier 24, which in turn energizes the vertical deflection plates of a coding tube in unit 25, The function of this tube is to convert the samples of the intelligence signal into a digital representation. This representation may have any one of 16 discrete amplitude levels, and for any one of these levels has the form of a set of binary digits of equal time duration, each of which may be a mark or a space. A coding tube of a type suitable for use in the present system is described in Sears U.S. Pat. No. 2,458,652 issued Jan. 11, 1949. In this connection reference is also made to Meacham U.S. Pat. No. 2,473,691 issued June 21, 1949.

The output of coding tube 25, after being subjected to pulse shaping in slicer unit 26, comprises a pulse train which may be referred to as the plain text binary code, and is illustrated by curve 9 of FIG. 3 of the drawings. This plain text binary code is supplied to a first cipher text generator 27, in which it is combined with a first autokey code developed, in accordance with the present invention, in a manner later to be described. The circuit of first cipher text generator 27 is so designed that as a mark or a space occurs in both signal and key codes simultaneously, no output, and hence a space, is obtained. If a mark is present in the signal code simultaneously with a space in the key code, or vice versa, an output mark is obtained. In other words, likes in both signal and key codes produce no output, represented by a space, whereas unlikes produce an output, represented as a mark.

The output of first cipher text generator 27, which may be referred to as the first coded text code, is gated in gate unit 28 for the purpose of obtaining a pulse which is discrete in time, and is then supplied to a second cipher text generator 29, in which it is combined with a second autokey code, developed, as fully disclosed in the above-mentioned copending application, in a manner to be described briefly later. The output of second cipher text generator 29 may be designated the second coded text code, and it is illustrated by curve 4 of FIG. 3.

This second coded text code is passed through a pulse widener unit 30, the output of which in turn is utilized to modulate a transmitter 31 which may be of any suitable type adapted to handle the required bandwidth. The purpose of unit 30 is to widen the pulses to the full width of the time interval, thus effectively decreasing the required transmitter bandwith. The output of transmitter 31 energizes a radiator 32 for supplying energy to the remainder of the system located at the receiving terminal.

For the purpose of providing the necessary periodic control signals, there is provided a standard frequency oscillator 33 which may operate, for example, at a frequency of 100 kilocycles per second. The output of this unit, as represented by curve 1 of FIG. 3, energizes a pulse generator 34, the output of which is subjected to a plurality of steps of frequency division in a frequency divider generally indicated at 35. Unit 35 includes a first frequency divider 36, the output of which is passed through a peaker 37 and supplied to a gate 38. A second frequency divider 39 is energized from divider 36 and supplies its output to gate 38 and to a cathode follower unit 40. Frequency dividers 41 and 42, also components of unit 35, are energized from divider 39 and in turn supply a sampling pulse generator 43, the principal function of which is to provide 6.25-kilocycle sampling pulses to sampler unit 23.

Sampling pulse generator 43 also supplies a blanking pulse and sweep generator 44, one output of which, represented by curve 3 of FIG. 3, is passed through a horizontal deflection amplifier 45 and utilized to provide the horizontal deflection of the electron beam in the coding tube of unit 25. Another output of unit 44 serves to blank out the electron beam in the coding tube of unit 25 during the retrace interval. The output of gate 38 is supplied to a pulse generator 46 followed by a cathode follower unit 47. The 25-kilocycle output of unit 47 is utilized to actuate gate 28 and is also supplied to an autokey control gate 48.

The output of cathode follower unit 40 (curve 7) is supplied to autokey generator 50 and also to a peaker unit 51, the output of which comprises a storage reset signal illustrated by curve 2 and furnished to autokey generator 50 and, both directly and through a delay network 52, to a pulse storage network 53. The delayed pulse train is illustrated by curve 6.

For the purpose of providing the first autokey code to be supplied to first cipher text generator 27, in accordance with the present invention a connection is made from the output of coding tube unit 25 to a first pulse gate 56, the output of which in turn is passed through a peaker unit 57 to pulse storage network 53. A first output of pulse storage network 53 is supplied to first cipher text generator 27 and a second output is supplied, through a delay network 58, to a recirculation gate 59. The output of the latter unit is supplied in turn to the input of pulse storage network 53.

For the purpose of actuating first pulse gate 56 and recirculation gate 59, a delay multivibrator unit 60 is provided. The input to this unit comprises the output of frequency-divider unit 35 (curve 10) and the output, which is supplied to first pulse gate 56, has the waveform shown by curve 11. The output supplied to recirculation gate 59 has an identical waveform but is of opposite polarity, as shown by curve 12.

For the purposes of providing the second autokey code, a connection is made from the output of second cipher text generator (curve 4) to a peaker unit 54, the output of which has a waveform shown by curve 5, this output being supplied to second autokey generator 50. The output of the latter generator is in turn supplied through autokey circuit gate 48 to second cipher text generator 29, the gated autokey code this supplied being illustrated by curve 8.

In order to enhance the security of the system, a low-level random noise signal is developed by a random generator 55 and injected into the speech channel after filter 21 but before limiter-compressor unit 22. The amplitude of this noise signal is adjusted so as to give a minimum signal-to-noise ratio consistent with intelligible communication and, in general, will be of sufficient amplitude to modulate the coding tube over the middle four levels, that is, the counts of six, seven, eight and nine. Due to the action of limiter-compressor unit 22, noise from generator 55 has a level substantially below the maximum level of the intelligence signal, as for example 30 decibels, and therefore introduces no objectionable effects into the speech path. Noise generator 55 may be of any suitable type, as for example an arrangement employing a gas tube as the source of random noise.

The arrangement in accordance with the present invention operates in the following manner still further to enhance the security of the system. The first binary digit of each code group is separated or gated out by firt pulse gate 56, passed through peaker unit 57, and supplied to pulse storage network 53. Since it has been assumed that each code group comprises four binary digits, network 53 consists of six stages, each of which provides a delay of approximately 40 microseconds, the width of a binary digit. Thus each input digit is available six digit intervals later at the output of network 53. The output of network 53 is passed through delay network 58 and recirculation gate 59 and then back into pulse storage network 53. The function of recirculation gate 59 is to permit any given input digit to circulate through pulse storage network 53 three times, gate 59 then being closed by the output of delay multivibrator unit 60 to permit a new first binary digit to be substituted in the position of the given binary digit in the storage network. This is accomplished by closing recirculation gate 59 at a 6.25-kilocycle rate during the occurrence interval of the first binary digit in each code group. If the pulse train were not recirculated a plurality of times through pulse storage network 53 in accordance with the present invention, it would be necessary for network 53 to have at least sixteen instead of only six stages to secure the same degree of security.

To better understand the operation of the system of the present invention, let it be assumed that first, second, third and fourth code groups, each of four binary digits, are produced by coding-tube unit 25. The autokey code group, to be combined in first cipher text generator 27 with the fourth binary code group, comprises four binary digits. The first digit is always a space. The second autokey digit corresponds with the first binary digit of the third code group. The third digit corresponds with the first binary digit of the second code group. The fourth autokey digit corresponds with the first binary digit of the first code group. It is evident, therefore, that three of the binary digits of the autokey code to be combined with any given code group correspond respectively with the first binary digit in each of the preceding three code groups.

If, instead of four binary digits, each code group comprises n digits, then network 53 will have $(n+2)$ stages, and $(n-1)$ of the autokey digits will correspond respectively with a selected binary digit in each of the preceding $(n-1)$ code groups. The first digit of each code group is preferably used as the basis for developing the autokey code groups because this digit has the greatest frequency of change, thus enhancing the randomness of the developed autokey code. It is within the scope of the present invention, however, to use other than the first binary digit of these preceding code groups as the basis for developing the autokey code groups.

The output of pulse storage network 53 is supplied to first cipher text generator 27 as the first autokey code, in which unit it is combined with the plain text binary code (curve 9) which appears at the output of slicer unit 26. It will be apparent, therefore, that the first autokey code is comprised not merely of a random combination of the four levels which corresponds with the presence of low-level noise, but instead this autokey code comprises a series of pulse groups which vary over a wider range of levels in a strickly random manner depending only upon the first binary digit of the three preceding binary code groups. Thus the inherent security of the system is substantially enhanced without any appreciable additional complication of the apparatus required at the transmitting terminal.

Figure 2:
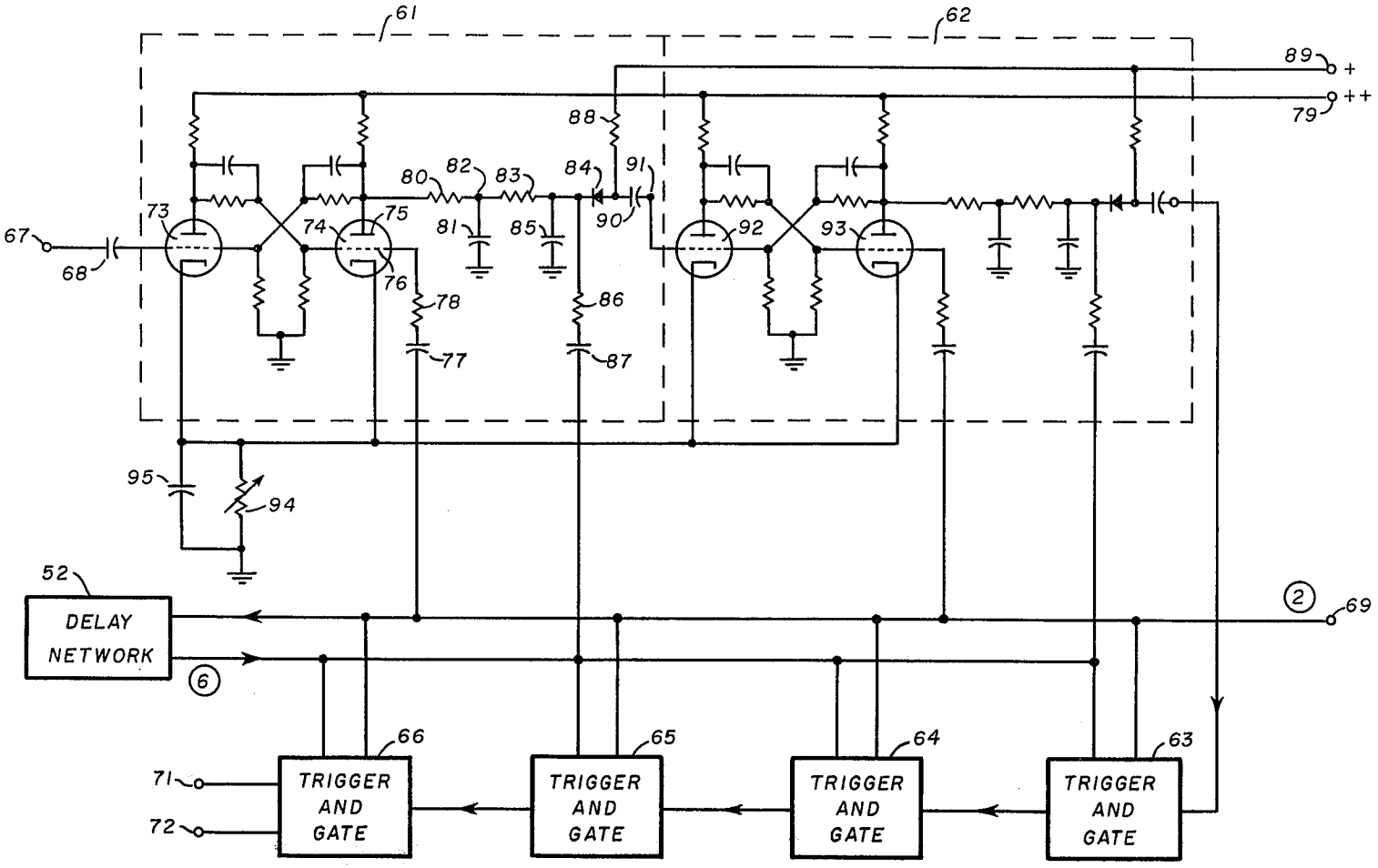
FIG. 2 is a schematic diagram, partly in block form, representing a dynamic pulse storage network and associated circuits of the type utilized in the system of FIG. 1.

FIG. 2 is a schematic diagram, partly in block form, of a dynamic pulse storage network and associated circuits of a type suitable for use in the system of FIG. 1. Such a network is designated generally by the reference numeral 53 in FIG. 1. As shown in FIG. 2, network 53 comprises six substantially identical trigger and gate stage 61, 62, 63, 64, 65 and 66 connected in cascade. The output of units 57 and 59 (FIG. 1) is applied to an input terminal 67 and, through a capacitor 68, to stage 61. Reset pulses (curve 2) from unit 51 (FIG. 1) are applied to a terminal 62, which in turn is connected to each stage as shown, and to a delay network 52 the output (curve 6) of which is also supplied to each of stage as shown. Last stage 66 is provided with two output terminals 71 and 72, for respectively supplying units 27 and 58 (FIG. 1).

First stage 61 comprises a pair of electron discharge devices 73 and 74, connected in a conventional Eccles-Jordan trigger circuit. In the absence of an input signal on terminal 67, device 73 is conductive and device 74 is non-conductive. The application of a negative pulse or mark at terminal 67 renders device 73 non-conductive and device 74 conductive, so that the potential of anode 75 of device 74 is low. A negative reset pulse (curve 2) applied to control electrode 76 of device 74, through a capacitor 77 and a decoupling resistor 78, causes this device to become non-conductive, so that the voltage of anode 75 rises substantially to that of the relatively high positive potential source 79.

An integrating network comprising a series resistor 80 and a shunt capacitor 81 is connected between anode 75 and ground. This network preferably has a time constant of approximately three-quarters of a digit interval. The junction 82 of resistor 80 and capacitor 81 is connected, through an isolating resistor 83, to the negative or cathode terminal of a gating rectifier 84, which may for example be a crystal diode. A capacitor 85 is connected between the negative terminal of rectifier 84 and ground. The negative terminal of rectifier 84 is also connected, through a resistor 86 and a capacitor 87, to the output of delay network 52. Capacitor 85 and 87 form a capacitive voltage divider, so that negative delayed reset pulses (curve 6) of reduced amplitude are applied to the negative terminal of rectifier 84. The positive or anode terminal of rectifier 84 is connected through a resistor 88 to a source of positive potential 89 having a value substantially equal to the lowest value which the negative terminal of rectifier 84 can attain during operation. A capacitor 90 couples the positive terminal of rectifier 84 to an output terminal 91.

Due to the action of integrating network 80-81, the above-mentioned sudden rise in voltage of anode 75 due to the application of a reset pulse (curve 2) to control electrode 76 of device 74 does not appear immediately at the negative terminal of rectifier 84. Under this condition, rectifier 84 is unblocked, and hence capable of passing on to output terminal 91 the negative delayed reset pulse (curve 6) which is applied to the negative terminal of rectifier 84. Since terminal 91 is connected to the input of second stage 62 comprising electron discharge devices 92 and 93, device 92 is rendered non-conductive and device 93 conductive. Thus the pulse or mark present in stage 61 is passed on to stage 62.

Let it now be assumed that a space is present in stage 61. Device 73 is conductive and device 74 is non-conductive, so that the potential of anode 75 of device 74 is high and the potential of the negative terminal of rectifier 84 is also high. Under this condition, rectifier 84 is so biased as to be virtually blocked. Thus the negative delayed reset pulse (curve 6) is not passed on to output terminal 91 and the input of stage 62. The latter stage, therefore, remains in its normal or space condition. In this manner, the space information is transferred from stage 61 to stage 62.

For the purpose of initially adjusting each of electron discharge devices 73, 74, 92 and 93 to their optimum operating points, there is provided an adjustable resistance 94 shunted by a capacitor 95 in the common path between the cathodes of these devices and ground. An initial adjustment of resistance 94 is normally all that is required until the discharge devices are replaced by new ones.

Stage 62 supplies stage 63, and so on through last stage 66, the operation in each case being as described in detail above with respect to stage 61. Output terminal 71, which supplies first cipher text generator 27, is connected to the anode of the first electron discharge device of last stage 66, in order that a positive square wave may be furnished. Output terminal 72 is coupled to the positive terminal of the gating rectifier of last stage 66, in the same manner that terminal 91 is related to first stage 61, so that a negative pulse train is furnished through delay network 58 to recirculation gate 59.

One of the important features of the pulse storage network in accordance with the present invention is that information comprising either marks or spaces or both in any combination is stepped along the chain in its proper time sequence. This desirable result is achieved by resetting each stage of the pulse storage network following each digit interval, this being done by applying a reset pulse at an appropriate time to each of the cascaded trigger circuits. A pulse storage network of the type herein disclosed provides substantially distortionless delay without the introduction of attenuation, even when a long storage interval is required. The duration of the storage period is readily varied merely by changing the periodicity of the reset pulse wave. Furthermore, the pulse storage network of the present invention is of the dynamic type, that is, a given unit of information supplied to its input is automatically carried through, with the desired delay, to be repeated at its output, whether or not the given unit is followed by a second unit of information. This is quite different from a storage network of the so-called static type, in which a first unit of information remains in the first stage until it is pushed along to the second stage by the imposition of a second unit of information at the input of the network, and so on through the chain until the first unit reaches the last stage.

While there has been described what is at present considered the preferred embodiment of the invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n − 1) of said binary digits corresponding respectively with a selected binary digit in each of the preceding (n.1) groups of said first pulse train; means for combining said first and second pulse trains to develop a third pulse train; and means for utilizing said third pulse train.

2. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n − 1) of said binary digits corresponding respectively with a selected binary digit in each of the preceding (n − 1) groups of said first pulse train, said means comprising a pulse storage network and means for passing said first pulse train through said network a plurality of times; means for combining said first and second pulse trains to develop a third pulse train; and means for utilizing said third pulse train.

3. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n − 1) of said binary digits corresponding respectively with a selected binary digit in each of the preceding (n − 1) groups of said first pulse train, said means comprising a pulse storage network and means including a recirculation gate for passing said first pulse train through said network a plurality of times; means for combining said first and second pulse trains to develop a third pulse train; and means for utilizing said third pulse train.

4. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n − 1) of said binary digits corresponding respectively with a selected binary digit in each of the preceding (n − 1) groups of said first pulse train, said means comprising a pulse storage network and means for passing said first pulse train through said network (n − 1) times; means for combining said first and second pulse trains to develop a third pulse train; and means for utilizing said third pulse train.

5. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n−1) of said binary digits corresponding respectively with a selected binary digit in each of the preceding (n−1) groups of said first pulse train, said means comprising a pulse storage network having a delay of (n+2) times the duration of a binary digit; means for combining said first and second pulse trains to develop a third pulse train; and means for utilizing said third pulse train.

6. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n−1) of said binary digits corresponding respectively with a selected binary digit in each of the preceding (n−1) groups of said first pulse train, said means comprising a pulse storage network having (n+2) stages each providing a delay of the duration of a binary digit; means for combining said first and second pulse trains to develop a third pulse train; and means for utilizing said third pulse train.

7. In a secret communication system including a source of an intelligence signal wave, means for periodically sampling said signal wave at predetermined intervals, and means for developing from the samples thus obtained a first pulse train comprising groups each having four binary digits: means for developing a second pulse train comprising groups of n binary digits, three of said binary digits corresponding respectively with a selected binary digit in each of the preceding three groups of said first pulse trains; means for combining said first and second pulse trains to develop a third pulse train; and means for utilizing said third pulse train.

8. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n−1) of said binary digits corresponding respectively with the first binary digit in each of the preceding (n−1) groups of said first pulse train; means for combining said first and second pulse trains to develop a third pulse train; and means for utilizing said third pulse train.

9. In a secret communication system including a source of an intelligence signal wave, means for periodically sampling said signal wave at predetermined intervals, and means for developing from the samples thus obtained a first pulse train comprising groups each having n binary digits: means for developing a second pulse train comprising groups of n binary digits, (n−1) of said binary digits corresponding respectively with the first binary digit in each of the preceding (n−1) groups of said first pulse train, said means comprising a pulse storage network having a delay of (n+2) times the duration of a binary digit; means for combining said first and second pulse trains to develop a third pulse train; and means for utilizing said third pulse train.

10. In a secret communication system including a source of an intelligence signal wave, means for periodically sampling said signal wave at predetermined intervals, and means for developing form the samples thus obtained a first pulse train comprising groups each having n binary digits: means for developing a second pulse train comprising groups of n binary digits, (n−1) of said binary digits corresponding respectively with the first binary digit in each of the preceding (n−1) groups of said first pulse train, said means comprising a pulse storage network having (n+2) stages each providing a delay of the duration of a binary digit; means for combining said first and second pulse trains to develop a third pulse train; and means for utilizing said third pulse train.

* * * * *